US009364710B2

(12) United States Patent
Tsukasako

(10) Patent No.: US 9,364,710 B2
(45) Date of Patent: Jun. 14, 2016

(54) LOWER LIMB BOUNCING DEVICE AND HIP JOINT STIMULATION METHOD

(71) Applicant: MKR-J CO., LTD., Hiroshima-shi, Hiroshima (JP)

(72) Inventor: Kikunori Tsukasako, Hatsukaichi (JP)

(73) Assignee: MKR-J CO., LTD., Hiroshima-shi (JP)

( * ) Notice: Subject to any disclaimer, the term of this patent is extended or adjusted under 35 U.S.C. 154(b) by 239 days.

(21) Appl. No.: 14/009,344

(22) PCT Filed: Feb. 21, 2013

(86) PCT No.: PCT/JP2013/054320

§ 371 (c)(1),
(2) Date: Oct. 2, 2013

(87) PCT Pub. No.: WO2013/172069

PCT Pub. Date: Nov. 21, 2013

(65) Prior Publication Data

US 2014/0057759 A1 Feb. 27, 2014

(51) Int. Cl.

| | |
|---|---|
| ***A63B 23/08*** | (2006.01) |
| ***A61H 1/00*** | (2006.01) |
| ***A61H 1/02*** | (2006.01) |

(52) U.S. Cl.

CPC ..... *A63B 23/08* (2013.01); *A61H 1/005* (2013.01); *A61H 1/0244* (2013.01); *A61H 2201/1215* (2013.01); *A61H 2201/1418* (2013.01); *A61H 2201/164* (2013.01); *A61H 2201/169* (2013.01); *A61H 2201/1664* (2013.01); *A61H 2201/1678* (2013.01); *A61H 2203/0431* (2013.01)

(58) Field of Classification Search

CPC ..... A63B 21/00
USPC ..... 482/79, 80
See application file for complete search history.

(56) References Cited

U.S. PATENT DOCUMENTS

| | | | | |
|---|---|---|---|---|
| 2,041,693 | A * | 5/1936 | Boltz et al. | 601/28 |
| 5,583,407 | A * | 12/1996 | Yamaguchi | 318/551 |
| 6,494,816 | B1 * | 12/2002 | Corrado | 482/79 |
| 6,878,102 | B1 * | 4/2005 | Commisso | 482/79 |
| 2007/0243979 | A1 * | 10/2007 | Hand | 482/110 |

FOREIGN PATENT DOCUMENTS

| | | | |
|---|---|---|---|
| JP | 2006-020651 | A | 1/2006 |
| JP | 2011-194051 | A | 10/2011 |
| WO | 03/045301 | A1 | 6/2003 |

* cited by examiner

*Primary Examiner* — Jerome W Donnelly
(74) *Attorney, Agent, or Firm* — Mots Law, PLLC

(57) ABSTRACT

A lower limb bouncing device causes knee bouncing by stimulating the hip joint, or base end of a lower limb, while allowing the lower leg, or terminal end of the lower limb, to relax. The device includes: a flap and a motor coupled to the flap. The flap allows a heel resting surface to swing from the motor. The motor includes: an output axis with an eccentric cam; and a pivotable plate on the eccentric cam. The pivotable plate has an attached pivoting end. The flap is on an enclosure side so that the heel can be placed at a minimum height above the floor when the foot is placed on the floor surface. The flap connects to another end of the pivotable plate allowing swing movement by the pivotable plate pivoting around the attached end in response to rotation of the eccentric cam.

7 Claims, 7 Drawing Sheets

LOWER LIMB BOUNCING DEVICE AND HIP JOINT STIMULATION METHOD

TECHNICAL FIELD

The present invention relates to a lower limb bouncing device mechanically causing "knee bouncing," or the habitual up and down motion of the heel while resting the toes on the ground.

BACKGROUND ART

Healthcare devices for feet have been suggested. For example, Patent Document 1 discloses a healthcare device for improving health by mechanically causing knee bouncing. This particular device includes a roller under the bottom surface of a footrest on which one rests his/her whole foot, the roller rotating to swing the footrest up and down.

CITATION LIST

Patent Literature

Patent Document 1: Japanese Patent Application Publication, Tokukai, No. 2011-194051

SUMMARY OF THE INVENTION

Problems to be Solved by the Invention

The abovementioned conventional feet healthcare device, however, has a shortcoming that the footrest gives a support to the whole foot (sole) in a manner that prevents the lower limb from relaxing, which inhibits a natural knee bouncing motion.

In addition, since the footrest is swung up and down by the roller disposed under the bottom surface of the footrest, the heel is already raised, as if standing on the toes, at the start of the motion so that the foot (ankle) is excessively plantar flexed. This also prevents the lower limb from relaxing, inhibiting a natural knee bouncing motion.

The present invention, conceived in view of these problems, has an object of providing a lower limb bouncing device effectively causing knee bouncing motion by stimulating the hip joint, or base end of a lower limb, while allowing the lower leg, or terminal end of the lower limb, to relax.

Solution to Problem

A lower limb bouncing device in accordance with the present invention, to solve the problems, includes: a flap on which a heel of a foot is to be placed; and a motor coupled to the flap. The flap is configured so that a heel resting surface thereof is swung up and down by a driving force of the motor, but does not fall below a minimum height position that is not more than 4 cm above a toe resting surface on which toes are to be placed.

In the lower limb bouncing device, the motor includes: an output axis on which an eccentric cam is provided; and a pivotable plate sitting on the eccentric cam, the pivotable plate having an end thereof pivotally attached so as to be pivotable. The flap is disposed on a side of an enclosure so that the heel can be placed at a minimum height position that is not more than 4 cm above a floor surface when the foot is placed on the floor surface on which the enclosure is disposed. The flap is connected to another end of the pivotable plate so as to be swung up and down by the pivotable plate pivoting up and down around the pivotally attached end in response to rotation of the eccentric cam.

In the lower limb bouncing device, the flap, when at the minimum height position, has therebelow a gap of 1 cm or larger, and when at a maximum height position, is elevated not more than 10 cm above the floor surface.

In the lower limb bouncing device, the flap is swung up and down 2 cm±1 cm between the minimum and maximum height positions.

A method of stimulating a hip joint which is a base end of a lower limb in accordance with the present invention, to solve the problems, includes mechanically moving a heel of a foot up and down by using a lower limb bouncing device that moves the heel up and down relative to stationary toes of the foot while the user is sitting, so as to stimulate the hip joint while the lower limb is relaxing.

In the method of stimulating a hip joint, while the heel is being moved up and down relative to the toes, the foot stays within any desired angle range between a state where an ankle joint is dorsiflexed 20° or less relative to a horizontal position thereof and a state where the ankle joint is plantar flexed 45° or less relative to the horizontal position so that the ankle joint is not overloaded.

Advantageous Effects of the Invention

As described in the foregoing, according to the present invention, the flap on which the heel is to be placed is configured so that the heel resting surface is swung up and down by a driving force of the motor, but does not fall below the minimum height position that is not more than 4 cm above the toe resting surface on which the toes are to be placed. The configuration enables knee bouncing motion without excessively plantar flexing the foot (ankle). Therefore, the present invention effectively causes knee bouncing motion while allowing the entire lower limb to relax, thereby effectively stimulating the hip joint which is the base end of the lower limb.

DESCRIPTION OF EMBODIMENTS

The following will describe embodiments of the present invention in reference to drawings.

Figure 1:
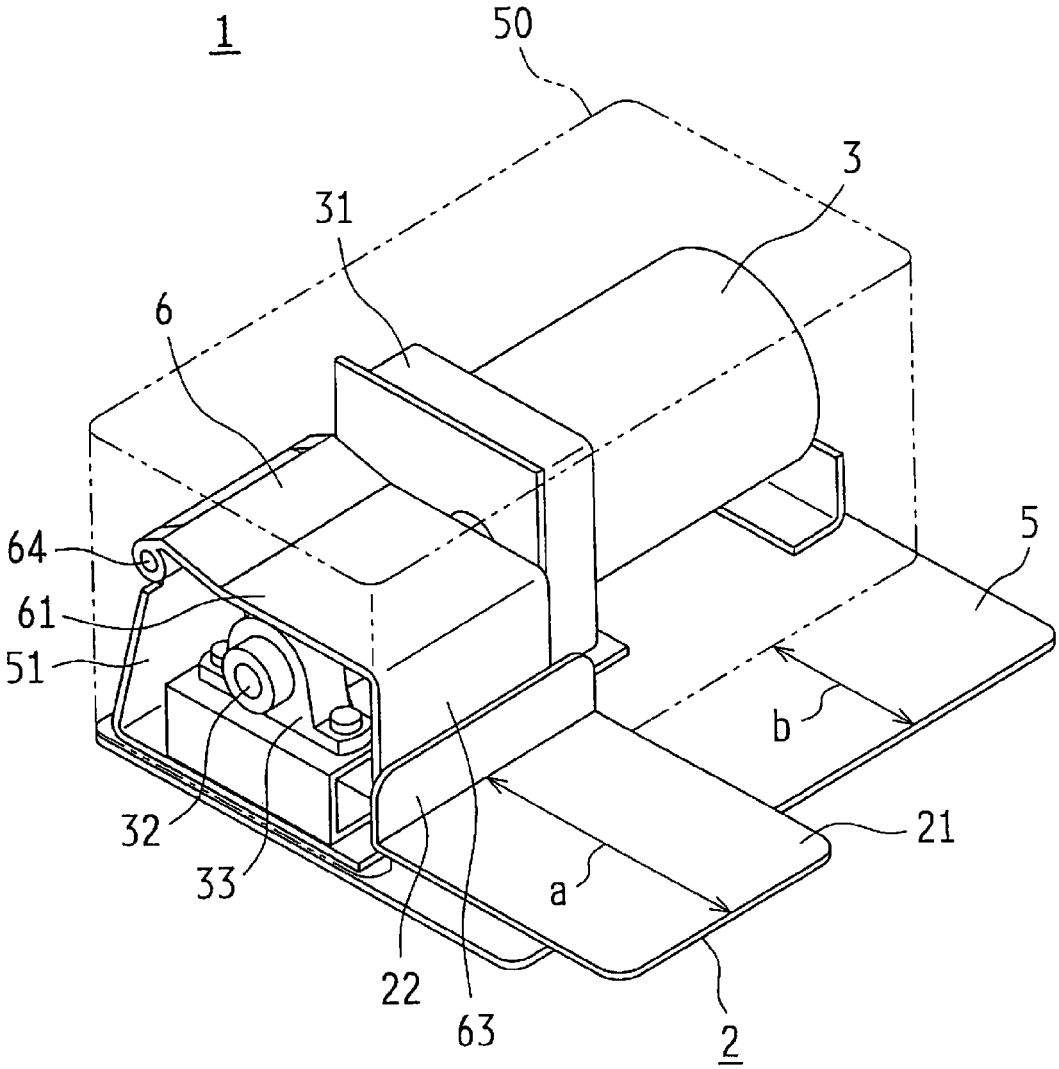
FIG. 1 is a schematic perspective view of the overall structure of a lower limb bouncing device in accordance with the present invention.
Figure 2:
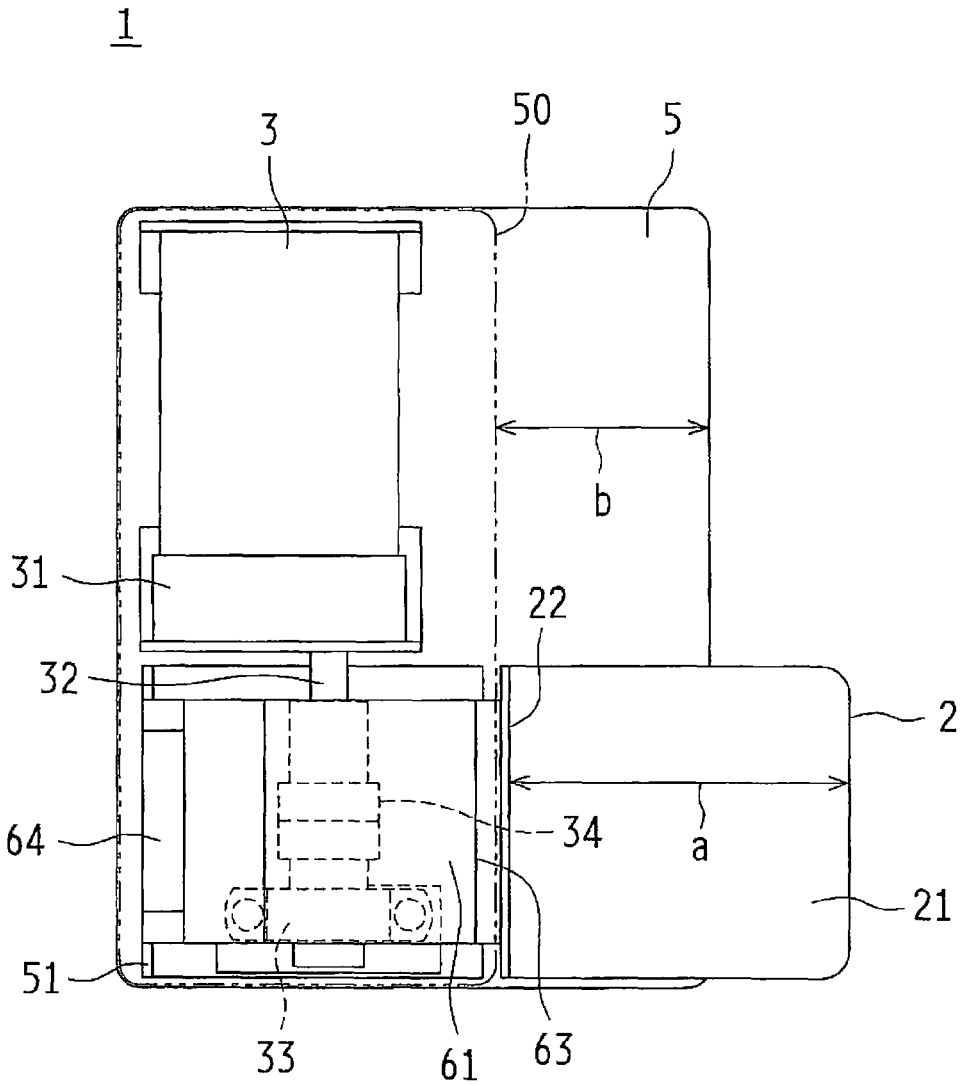
FIG. 2 is a schematic plan view of the overall structure of the lower limb bouncing device in accordance with the present invention.
Figure 3:
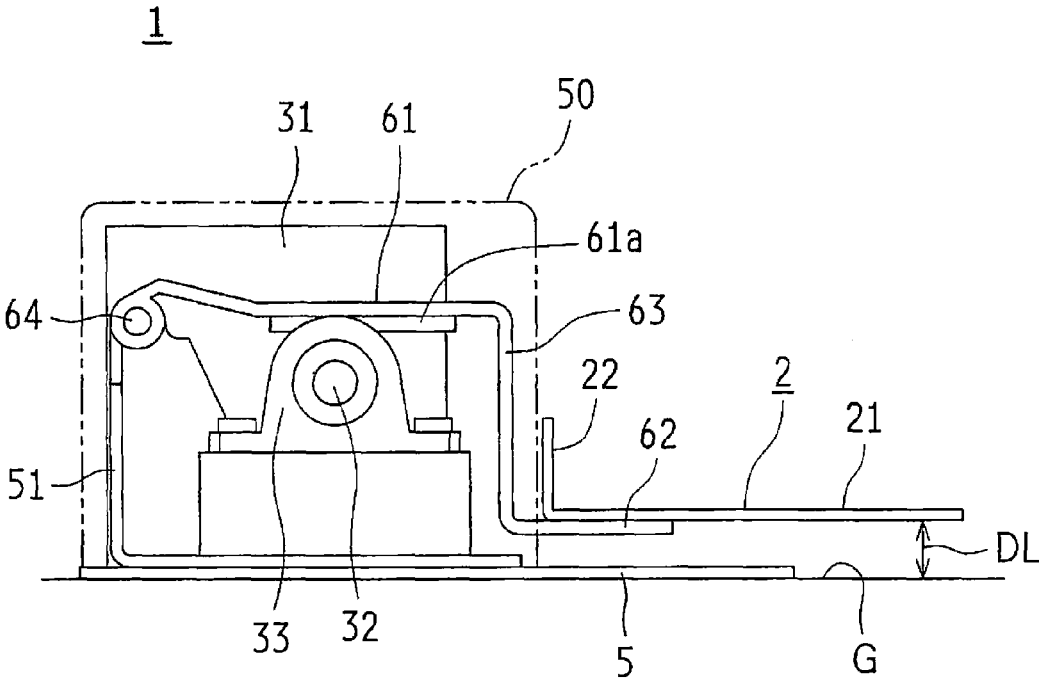
FIG. 3 is a schematic side view of the overall structure of the lower limb bouncing device in accordance with the present invention.
Figure 4:
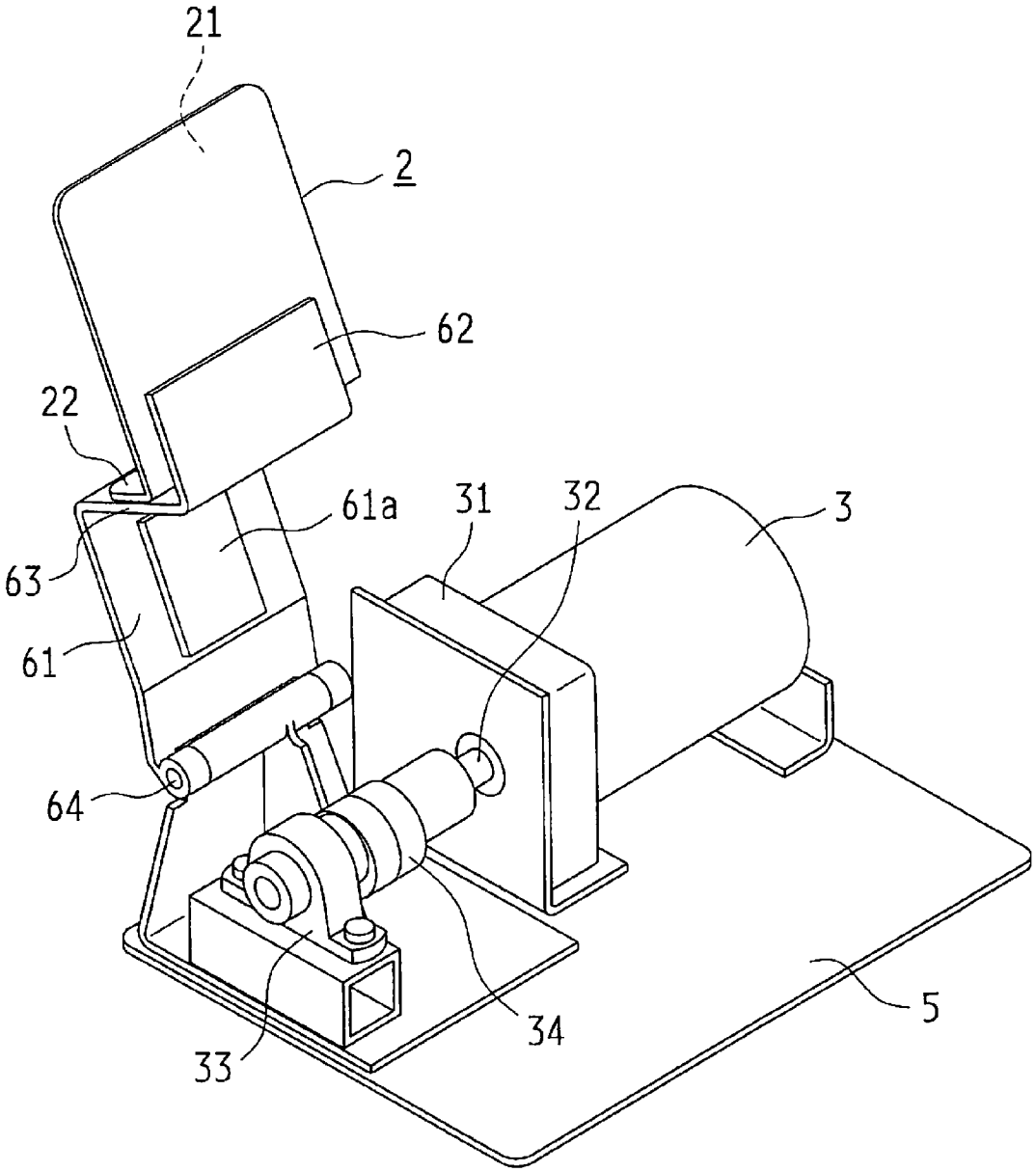
FIG. 4 is a perspective view of the lower limb bouncing device in accordance with the present invention, with a pivotable plate elevated to show an eccentric cam.
Figure 5A:
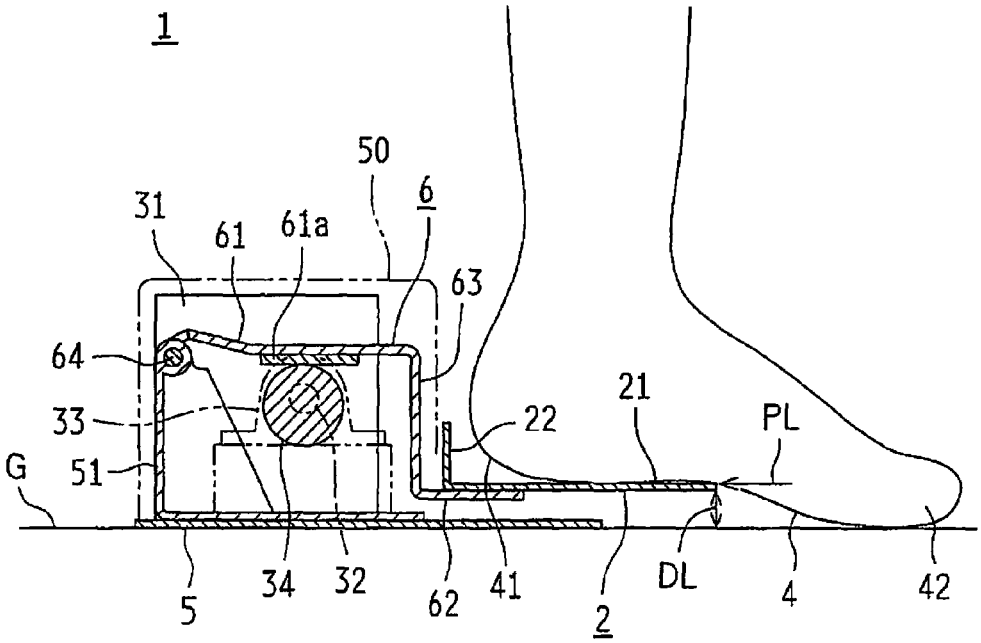
FIG. 5(*a*) and FIG. 5(*b*) are side views of the lower limb bouncing device in accordance with the present invention in a minimum height position state and a maximum height position state respectively in actual use.
Figure 5B:
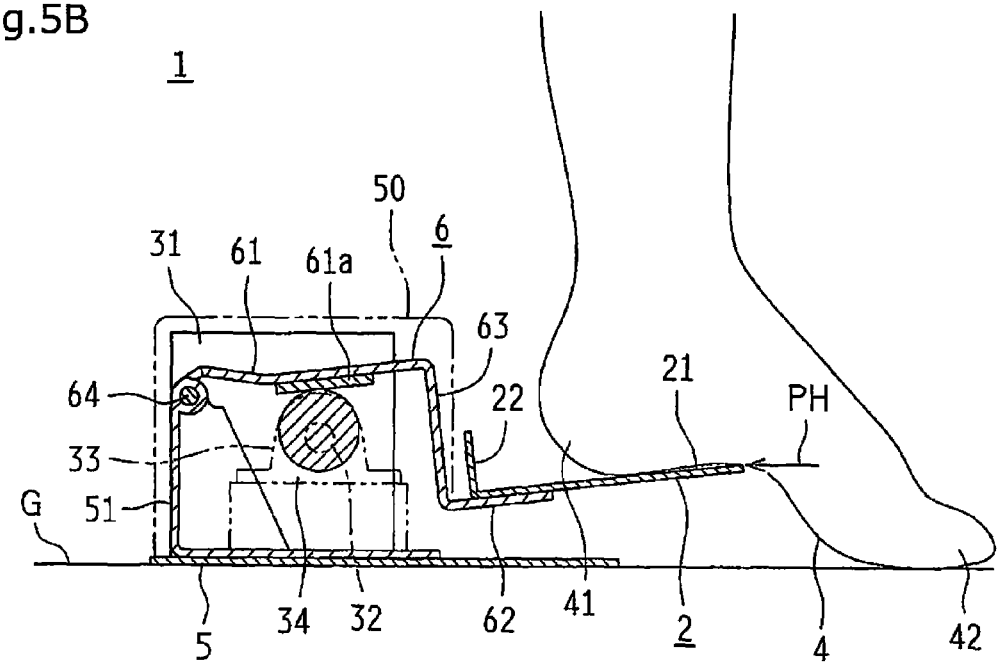
Figure 6A:
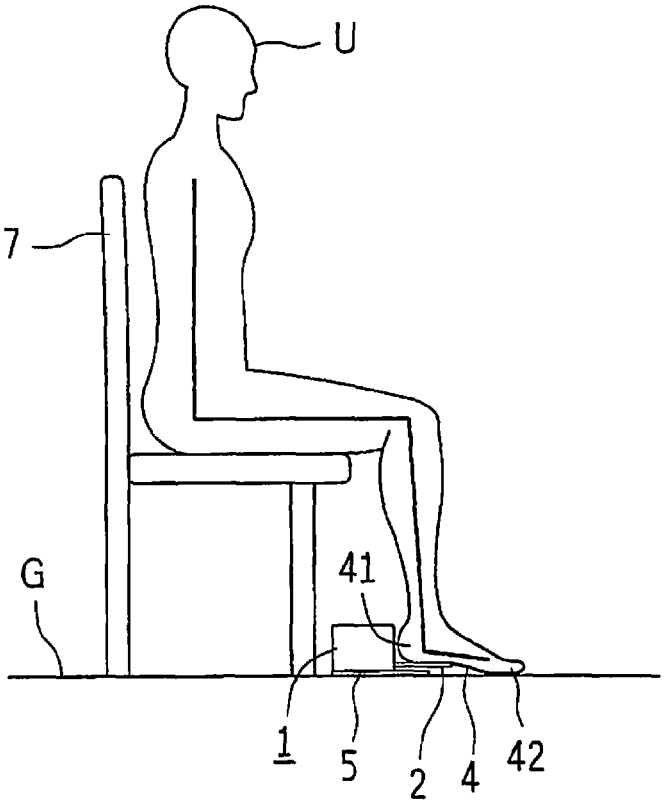
FIG. 6(*a*) and FIG. 6(*b*) are side views of the user and the lower limb bouncing device in association with FIG. 5(*a*) and FIG. 5(*b*) respectively.
Figure 6B:
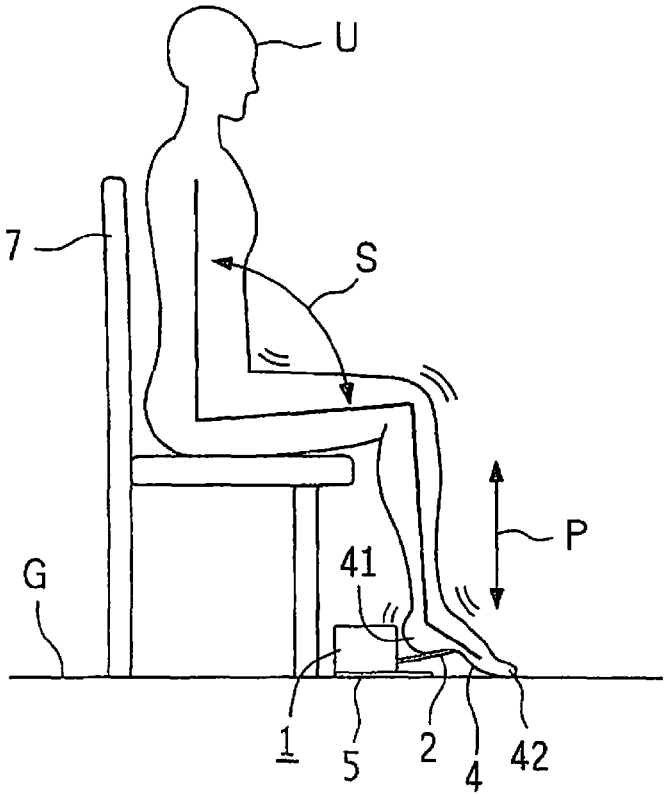

FIGS. 1 to 3 show a lower limb bouncing device 1 in accordance with the present invention. FIG. 4 shows the internal structure of the lower limb bouncing device 1. FIGS. 5 and 6 show the lower limb bouncing device 1 in actual use.

The lower limb bouncing device 1 includes a flap 2 and a motor 3. The flap 2 is coupled to the motor 3 so that a heel resting surface 21 of the flap 2 swings up and down.

The flap 2 has such dimensions that the heel 41 of the foot 4 can be placed on the heel resting surface 21. A vertical abutment 22 may be provided extending upwards from an edge of the heel resting surface 21. The vertical abutment 22 serves as a stopper for the heel 41 when the heel 41 is placed on the heel resting surface 21 of the flap 2. The flap 2, or at least the heel resting surface 21 thereof, may be non-slip finished so that the heel 41 of the foot 4 does not slip when it is placed thereon. The non-slip finishing may be carried out through irregular surface fabrication (grooves, embossment, etc.) or by attaching a rubber-, resin-, or cloth-based non-slip material.

The motor 3 is secured on a board 5 and transfers a rotational force to an output axis 32 via a gear box 31 to rotate the output axis 32. The output axis 32 has an end thereof supported by a bearing 33. An eccentric cam 34 is disposed on the output axis 32 between the bearing 33 and the gear box 31. The eccentric cam 34 may, for example, be columnar with a diameter of about 2 cm and attached to the output axis 32 about 3 mm off its center.

The eccentric cam 34 is contacted by a pivotable plate 6 from above. The pivotable plate 6 may be a long steel plate bent to form two steps (i.e., an eccentric cam contact portion 61 that comes in contact with the eccentric cam 34 and a flap securing portion 62 to which the flap 2 is secured) linked by a step-linking portion 63. The eccentric cam contact portion 61 of the pivotable plate 6 may be reinforced by providing a contact plate 61*a* to a part thereof with which the eccentric cam 34 comes in contact. The pivotable plate 6, at an end thereof close to the eccentric cam contact portion 61, is pivotally attached to an end of a bracket 51 erected on the board 5 to form a hinge 64, so that the pivotable plate 6 is in contact with the eccentric cam 34 in such a manner that the contact plate 61*a* contacts the eccentric cam 34 from above. The flap 2 is secured onto the flap securing portion 62 so that the flap 2 extends from an end of the pivotable plate 6 close to the flap securing portion 62. With the flap 2 thus secured, there is formed a gap between the step-linking portion 63 of the pivotable plate 6 and the vertical abutment 22 of the flap 2. The entire drive mechanism, including the motor 3, is housed in an enclosure 50 so that only a part of the flap securing portion 62 beyond the vertical abutment 22 as seen from the gap sticks out of the enclosure 50. The board 5 is provided extending underneath the flap 2 so that the lower limb bouncing device 1 is stable when the heel 41 of the foot 4 is placed on the heel resting surface 21 of the flap 2. Specifically, the board 5 may be provided extending ⅓ the distance a from an end of the heel resting surface 21 close to the vertical abutment 22 to the opposite end, preferably at least half that distance ("distance b"), so that the heel resting surface 21 does not lurch and contact the floor surface G when the heel 41 of the foot 4 is placed on the heel resting surface 21 of the flap 2.

According to the structure, the pivotable plate 6 pivots around the hinge 64 in response to the rotation of the eccentric cam 34 driven by the motor 3. The pivoting in turn swings up and down the flap 2 secured to the flap securing portion 62. The swing distance may be set by adjusting the eccentricity of the eccentric cam 34, the length of the pivotable plate 6, or the position of the pivotable plate 6 that comes into contact with the eccentric cam 34.

Specifically, a minimum height position PL for the flap 2 is preferably specified so that a 1-cm or larger gap DL is left between the underside of the flap 2 and the extension of the board 5 when the pivotable plate 6 is in contact with the eccentric cam 34 in such a manner that the flap 2 is at its lowest in height. This specification is not intended to exclude a gap DL narrower than 1 cm. A 1-cm or larger gap DL prevents a child from being injured from accidentally placing a finger under the flap 2. Therefore, a 2-cm or larger gap DL is preferable for better safety. On the other hand, too large a gap DL forces the ankle joint to be plantar flexed where the heel 41 at the minimum height position PL is still excessively higher than the toes 42 placed on the floor surface G when the heel 41 of the foot 4 is placed on the heel resting surface 21 of the flap 2. The ankle joint is plantar flexed further from this position, increasing load on the lower leg. Therefore, the minimum height position PL for the flap 2 is specified so that the heel 41 is not more than 4 cm above the floor surface G on which the toes 42 of the foot 4 are placed. Assuming that the flap 2 has a thickness of 2 mm, the minimum height position PL is specified 12 mm to 4 cm above the floor surface G.

A maximum height position PH for the flap 2 is also specified so that the underside of the flap 2 is separated by a distance of not more than 10 cm from the floor surface G on which the toes 42 of the foot 4 are placed when the pivotable plate 6 is in contact with the eccentric cam 34 in such a manner that the flap 2 is at its highest in height. If the distance exceeds 10 cm, the foot (ankle) 4 is plantar flexed so much as to receive excessive load on the lower leg.

A difference, PH-PL, (i.e., the swing distance) between a state where the pivotable plate 6 is in contact with the eccentric cam 34 in such a manner that the flap 2 is at the minimum height position PL where the flap 2 is at its lowest in height and a state where the pivotable plate 6 is in contact with the eccentric cam 34 in such a manner that the flap 2 is at the maximum height position PH where the flap 2 is at its highest in height is set not more than 6 cm, preferably not more than 4 cm, more preferably not more than 2 cm. If the swing distance exceeds 6 cm, the foot (ankle) 4 receives excessive load from the plantar flexion in each swing; an aged user, for example, may not be able to keep the toes 42 on the floor surface G, ending up placing the entire foot 4 on the heel resting surface 21 of the flap 2. Although this may be one of available use modes, the foot 4 and nearby parts of the foot experience no motion in the mode. That in turn leads undesirably to insufficient knee bouncing motion, increased load on the heel resting surface 21, and increased workload for the motor 3.

The lower limb bouncing device 1, constructed as above, may rely on an external power supply or a charged battery (not shown) provided inside the enclosure 5, to power the motor 3.

The lower limb bouncing device 1, when used, is disposed close to a front leg of a chair 7 on which the user U is sitting as illustrated in FIG. 6 because the lower limb bouncing device 1 is intended to cause knee bouncing motion. The chair 7 is not limited in any particular manner and may be any one of popularly used, various types of chairs: chairs used at home, those at an office, seats in a long distance bus, passenger car, airplane, train coach, and other forms of transport, those in a cinema, music hall, and other various premises, and chairs/seats at a restaurant. The lower limb bouncing device 1 may be disposed close to a front leg of the chair 7 at any of these places.

Next will be described how to use the lower limb bouncing device 1.

First, the lower limb bouncing device 1 is disposed close to a front leg of the chair 7 on which the user U is sitting. The heel 41 of the foot 4 is then placed on the heel resting surface 21 of the flap 2, and the motor 3 is subsequently actuated.

The motor 3 may be actuated/deactuated by turning on/off a switch (not shown) provided on a power supply cord (not shown) or on the enclosure 5 or by remote-controlling control circuitry (not shown) for the motor 3 using a separately provided remote control device (not shown). The motor 3 may maintain a constant rotational speed or provide a rotational speed that can be varied using a switch (not shown), remote control device (not shown), or like device.

The actuated motor 3 causes the heel resting surface 21 of the flap 2 to swing up and down relative to the floor surface G on which the toes 42 are placed. The up and down swings P in turn move the heel 41 up and down, which achieves a motion mimicking knee bouncing motion.

The foot (ankle) 4 is prevented from experiencing excessive plantar flexion at the start of the motion because the minimum height position PL for the heel resting surface 21 of the flap 2 is set not more than 4 cm above the floor surface G on which the toes 42 are placed. In addition, since the maximum height position PH is set not more than 10 cm above the floor surface G, the foot (ankle) 4 experiences suitable plantar flexion throughout the knee bouncing motion. If the rotational speed of the motor 3 is too fast, however, the heel 41 cannot keep up with the up and down swings P of the flap 2; the flap 2 may beat the heel 41 so that the toes 42 cannot be kept on the floor surface G. On the other hand, if the rotational speed of the motor 3 is slow, the heel 41 can keep up with the up and down swings of the flap 2. If the rotational speed is too slow, the frequency of the knee bouncing motion is insufficient. Therefore, the rotational speed of the motor 3 should be set to generate approximately 5 to 150, preferably 30 to 120, more preferably 60 to 90 sets of an up swing and a down swing P per minute. The knee bouncing motion stimulates the foot (ankle) 4, or terminal end of the lower limb, by the repetitive plantar flexion motion and at the same time stimulates the hip joint, or base end of the lower limb, by effective pivoting motion T of the hip joint. The knee bouncing motion hence stimulates the entire lower limb by the bouncing motion.

Therefore, the lower limb bouncing device 1 enables aged users who are unable to be engaged in active exercise to effectively relax their hip joints, which helps them walk easily by virtue of expanded range of motion of the lower limb and improve blood flow.

The user, whether aged or not, can prevent development of so-called economy-class syndrome by, for example, disposing the lower limb bouncing device 1 close to a front leg of a seat in a long distance bus, airplane, train coach, etc.

In the present embodiment, the lower limb bouncing device 1 is used to plantar flex the foot (ankle) 4 with the heel 41 of the foot 4 being placed on the heel resting surface 21 of the flap 2, so that the hip joint can effectively experience pivoting motion T for stimulation. Alternatively, the lower limb bouncing device 1 may be used to dorsiflex the foot (ankle) 4 with the toes 42 of the foot 4 being placed on the heel resting surface 21 of the flap 2, so that stimulation only comes from dorsiflexion of the foot (ankle) 4. When this is actually the case, the swing distance for the lower limb bouncing device 1 should be set to not more than 4 cm, preferably not more than 2 cm, because the dorsiflexion angle for a typical user is approximately ⅔ of the plantar flexion angle, that is, the dorsiflexion angle to the horizontally placed foot 4 is about 20° for the plantar flexion angle of about 45°. In addition, to cause knee bouncing motion by plantar flexing the foot (ankle) 4 in up and down swings P with the heel 41 of the foot 4 being placed on the heel resting surface 21 of the flap 2, the lower limb bouncing device 1 may be set up to cause the heel 41 to undergo up and down swings P within any angle range between the abovementioned plantar flexion angle of about 45° and the abovementioned dorsiflexion angle of about 20°. If the lower limb bouncing device 1 is to be set up to cause the heel 41 to undergo up and down swings P almost up to the plantar flexion limit (45°) or the dorsiflexion limit (20°), the foot (ankle) 4 is preferably plantar flexed starting from a horizontal position or from a position where the foot (ankle) 4 is already plantar flexed a little as illustrated in FIG. 6 to cause the up and down swings P, hence the knee bouncing motion, to avoid excessive load on the foot (ankle) 4 and the lower leg. Furthermore, as long as the user is sitting on a chair, the upper limb does not need to be kept in a vertical position as shown in FIG. 6; the user may bend forward or backward if necessary.

Figure 7:
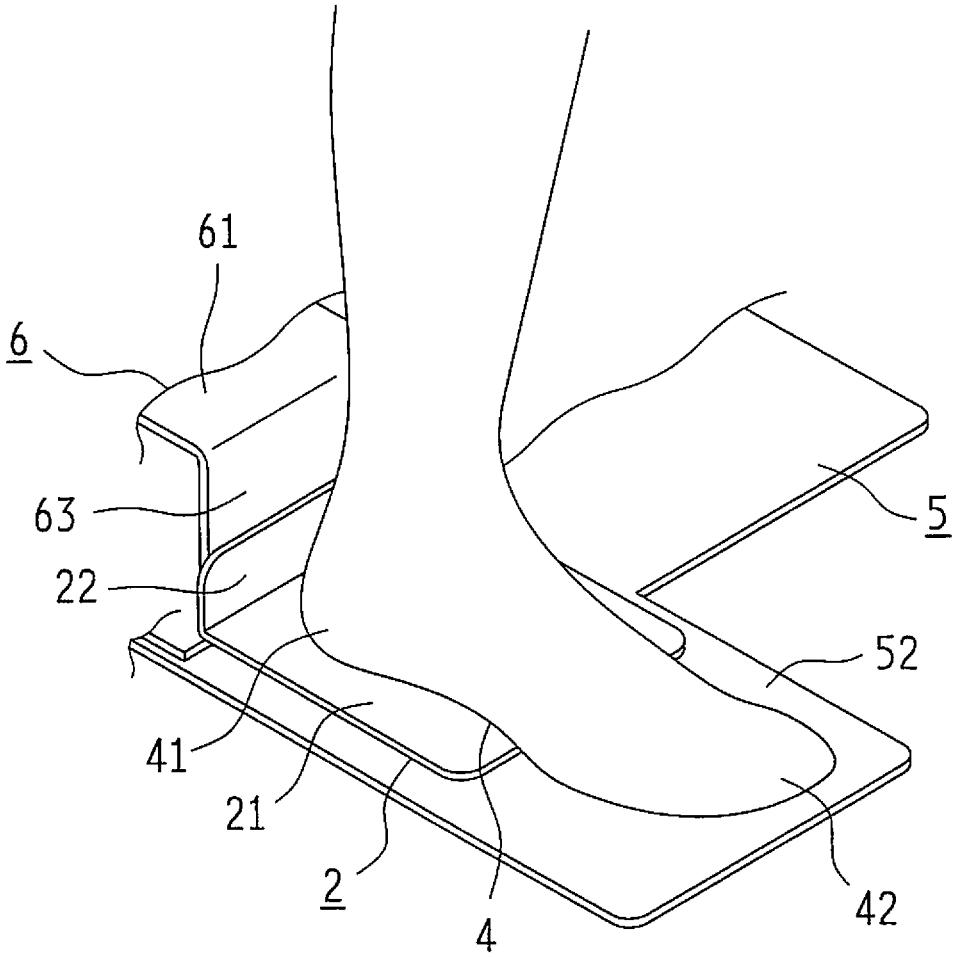
FIG. 7 is a perspective view of a part of another embodiment of the lower limb bouncing device in accordance with the present invention.

In the present embodiment, the toes 42 of the foot 4 are placed on the floor surface G. Alternatively, the lower limb bouncing device 1 may be designed to have an extension of the board 5 serving as a heel rest 52 so that the toes 42 can be placed thereon as illustrated in FIG. 7. When this is actually the case, since the toes 42 of the foot 4 are placed not on the floor surface G, but on the surface of the heel rest 52, the gap DL, the minimum height position PL, and the maximum height position PH are measured not from the floor surface G, but from the surface of the heel rest 52. The heel rest 52 may be provided with, for example, a strap (not shown) securing the toes 42 to prevent the toes 42 from being displaced during knee bouncing motion.

In the lower limb bouncing device 1 of the present embodiment, the motor 3 rotates the eccentric cam 34 which pivots up and down the pivotable plate 6 which in turn swings up and down the flap 2 secured to the pivotable plate 6. The flap 2 is not necessarily swung up and down by this particular drive mechanism. Alternatively, the mechanism may include a combination of various gears, a chain complete with a sprocket, or a belt.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The lower limb bouncing device in accordance with the present invention is useful for improving health in various environments where a chair or seat is available.

REFERENCE SIGNS LIST

1 Lower Limb Bouncing Device
2 Flap
21 Heel Resting Surface
3 Motor
32 Output Axis
34 Eccentric Cam
4 Foot
41 Heel
42 Toes
5 Board
52 Heel Rest
6 Pivotable Plate G Floor Surface
U User
P Up and Down Swing
S Pivoting

The invention claimed is:

1. A lower limb bouncing device having a lower surface that contacts a floor, comprising: a flap on which a heel of a foot is to be placed; and a motor coupled to the flap, the flap being configured with a heel resting surface thereof being swung up and down by a driving force of the motor, but does not fall below a minimum height position that is not more than 4 cm above a toe resting surface on which toes are to be placed, the motor including: an output axis on which an eccentric cam is provided; and a pivotable plate sitting on the eccentric cam, the pivotable plate having an end thereof pivotally attached, and the flap being disposed on a side of an enclosure that accepts placement of the heel at a minimum height position that is not more than 4 cm above a floor surface when the foot is placed on the floor surface on which the enclosure is disposed, the flap being connected to another end of the pivotable plate that allows up and down swinging thereof by the pivotable plate pivoting up and down around the pivotally attached end in response to rotation of the eccentric cam.

2. The lower limb bouncing device as set forth in claim 1, wherein the flap, when at the minimum height position, has therebelow a gap of 1 cm or larger, and when at a maximum height position, is elevated not more than 10 cm above the lower surface that contacts the floor.

3. The lower limb bouncing device as set forth in claim 1, wherein the flap is dimensioned to swing up and down 2 cm±1 cm between the minimum and maximum height positions.

4. A method of stimulating a hip joint which is a base end of a lower limb, said method comprising mechanically moving a heel of a foot up and down by mechanical action of a heel foot rest adjacent to a stationary toe resting surface using a lower limb bouncing device that moves the heel resting on the heel foot rest, up and down relative to stationary toes of the foot while the user is sitting, so as to stimulate the hip joint while the lower limb is relaxing, wherein the heel foot rest is swung up and down by a motor, but the vertical movement thereof does not fall below a minimum height position that is not more than 4 cm above the stationary toe resting surface.

5. The method as set forth in claim 4, wherein while the heel is moved up and down relative to the toes, and the foot stays within any desired angle range between a state where an ankle joint is dorsiflexed 20° or less relative to a horizontal position thereof and a state where the ankle joint is plantar flexed 45° or less relative to the horizontal position so that the ankle joint is not overloaded.

6. The method as set forth in claim 3, wherein the stationary toe resting surface is a floor.

7. The method as set forth in claim 3, wherein the stationary toe resting surface is an extension of a board serving as a heel rest.

* * * * *